US005787846A

United States Patent [19]

Schimmeyer

[11] Patent Number: 5,787,846

[45] Date of Patent: Aug. 4, 1998

[54] VARIABLE FLOW VOLUME CONTROL BAFFLE FOR WATER HEATER

[76] Inventor: Werner K. Schimmeyer, 8937 Acorn Pl., Santa Rosa, Calif. 95409

[21] Appl. No.: 585,668

[22] Filed: Jan. 16, 1996

[51] Int. Cl.[6] ..... F22B 7/00; F22B 9/00

[52] U.S. Cl. ..... 122/155.2; 122/44.2; 122/136 R; 122/DIG. 3; 126/365

[58] Field of Search ..... 122/14, 17, 29, 122/44.2, 45, 47, 48, 135.1, 136 R, 84, 85, DIG. 3, 155.2; 126/362, 364, 365

[56] References Cited

U.S. PATENT DOCUMENTS

| | | | |
|---|---|---|---|
| 3,349,754 | 10/1967 | Bock | 122/17 |
| 4,702,226 | 10/1987 | Shelley | 126/362 |
| 4,770,160 | 9/1988 | Schimmeyer | 126/285 |
| 4,951,614 | 8/1990 | Akkala et al. | 122/17 |
| 5,239,947 | 8/1993 | Schimmeyer | 122/17 |
| 5,544,625 | 8/1996 | Rivern | 122/155.2 |
| 5,588,399 | 12/1996 | Kim | 122/17 |

FOREIGN PATENT DOCUMENTS

| | | | |
|---|---|---|---|
| 399604 | 10/1933 | United Kingdom | 122/17 |

*Primary Examiner*—William Doerrler
*Attorney, Agent, or Firm*—Walter A. Hackler

[57] ABSTRACT

Apparatus for improving the efficiency of a water heater having a tank, a burner and a flue, the flue being disposed within said tank for evacuation of burned combustion gases therethrough with resulting heating of water in the tank, generally including combustion gas deflector for enhancing heat transfer from the combustion gases through a flue wall and into surrounding water during ignition of the burner.

10 Claims, 1 Drawing Sheet

VARIABLE FLOW VOLUME CONTROL BAFFLE FOR WATER HEATER

The present invention generally relates to apparatus for gas and/or oil water heaters and is more particularly adapted to apparatus for improving the efficiency of a gas and/or oil water heater, hereinafter generally referred to as a gas water heater.

Typical fuel-burning water heaters include a combustion chamber disposed in a base of a water tank with a flue disposed within the tank for evacuation of the burner combustion gases therethrough and concomitant heating of water in the tank. The combustion gases exiting the water heater flue are typically passed through an exhaust flue for proper venting.

The present invention provides apparatus for the enhancement of heat transfer from the combustion gases to water in a hot water heater through a flue.

SUMMARY OF THE INVENTION

Apparatus in accordance with the present invention for improving the efficiency of the gas water heater having a tank, gas burner, and, a flue, with the flue being disposed within the tank, generally includes combustion gas directing means for enhancement of heat transfer from the combustion gases through the flue and the surrounding water during ignition of the burner. Thus, a baffle is provided to control the flow of combustion gases within the flue. Because of enhanced heat transfer, more of the heat carried by the heat combustion gases is transferred into water during an ignition cycle of the burner.

The present invention may be used in combination with a damper for preventing ambient air in the flue, heated by the directing means in the flue, from escaping the flue during nonignition periods of the burner as set forth in companion copending U.S. patent application entitled VARIABLE FLOW VOLUME CONTROL BAFFLE AND VENT DAMPER Ser. No. 08/585,497 filed on even date herewith, now U.S. Pat. No. 5,682,841.

As noted in the referenced copending patent application, the damper means may be any suitable type of vent damper such as disclosed in U.S. Pat. Nos. 4,770,160 and 5,239,947 to Schimmeyer.

In accordance with the present invention, the combustion directing means may be elongate and include a plurality of nestable segments. This embodiment is particularly suited for the retrofit of existing water heaters where space above the installed water heater is limited, that is, without sufficient space for the installation of a unitary elongate member into the water tank flue.

More particularly, each of the plurality of segments may be cylindrical with each having a different diameter to enable the assembly of the elongate member with a diameter smaller at a bottom of the elongate member than at the top of the elongate member and provide a variable flow control baffle for combustion gases.

This provides for establishing an annulus around the elongate member and the flue for the passage of combustion gas which widens into the direction of the combustion gas flow up the flue and to an external exhaust flue.

While the specific embodiment hereinabove cited is suitable for the retrofit of the existing water heaters, it should be appreciated that the present invention also includes a water heater having a tank and a burner with a flue means, disposed in the tank, for evacuation of burner combustion gases therethrough with the resulting heating of the water tank. In combination therewith, combustion gas direct means are provided for enhancing the heat transfer from the combustion gas through the flue and into the surrounding water during ignition of the burner.

BRIEF DESCRIPTION OF THE DRAWINGS

The advantages and features of the present invention will be better understood by the following description when considered in conjunction with the accompanying drawings in which.

DETAILED DESCRIPTION

Figure 1:
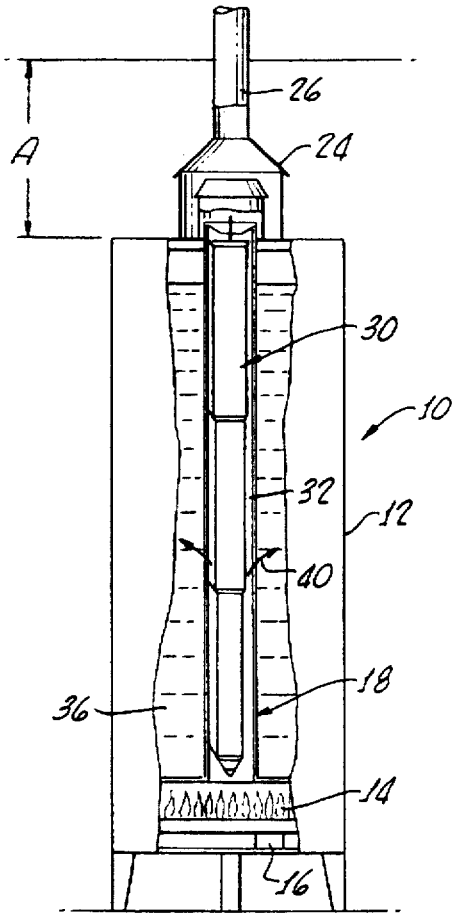
FIG. 1 is a plan view, partially broken away, of one embodiment of the present invention, generally showing a water tank with a flue therethrough heated by a burner in combination with a flue device for enhancing heat transfer.
Figure 3:
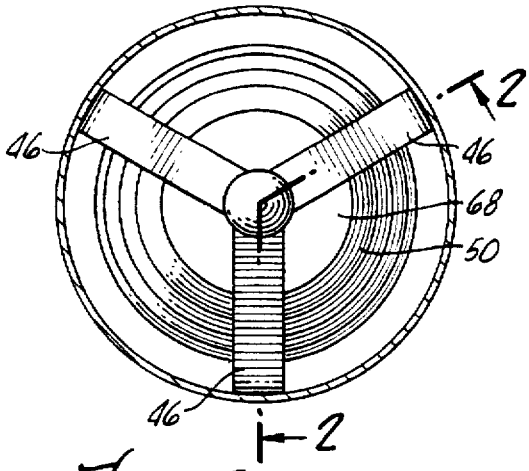
FIG. 3 is a cross-sectional view taken alone the line 3—3 in FIG. 2.
Figure 2:
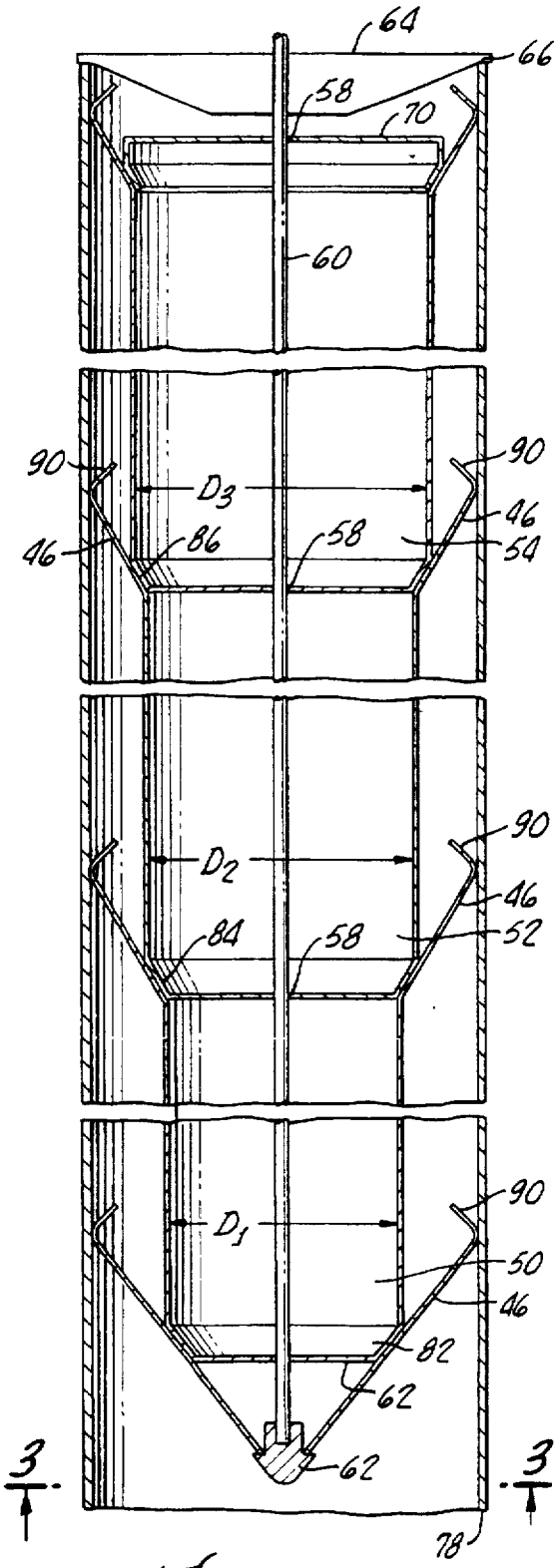
FIG. 2 is a cross-sectional view of the combustion gas directing means, in accordance with the present invention, particularly suitable for retrofit of existing water heaters.

Turning now to FIG. 1–3, there is shown a water heater apparatus 10, in accordance with the present invention, which generally includes a tank 12, a burner 14, disposed at the bottom portion 16 of the tank, along with a flue 18 which provides a means for evacuation of burner gases therethrough to a vent damper 24 and thereafter to an exhaust flue 26.

It should be appreciated that the tank 12, burner 14, and flue 18 of the apparatus 10 may be of any conventional suitable design. In addition, the vent damper 24 may be made in accordance with U.S. Pat. Nos. 4,770,160 or 5,239,947 which are incorporated herewith for providing a description of how to make and use the vent damper 24. An important component of the present invention is the heat deflector 30 which provides means for enhancing heat transfer from the combustion gases through a flue wall and into surrounding water 36, as indicated by the arrows 40 in FIG. 1.

The deflector 30 effects an enhancement of heat transfer two ways. First, the deflector 30 directs rising combustion gases from the burner 14 against the flue wall 32. Additionally, conductive heat transfer from the heat deflector 30 is provided to the flue wall as hereinafter discussed in greater detail.

Turning again to FIG. 2, the deflector 30 may be comprised of a plurality of cylindrical sections, or segments, 50, 52, 54, each having a length, for example, of between 12 and 14 inches in order to enable the installation of the segments 50, 52, 54 into the flue 18 when the damper 24 is removed from the tank 12 and a clearance of both an installed tank A, as shown in FIG. 1, precludes the installation of a unitary deflector (not shown).

Segments 50, 52, 54 may be formed from any suitable material, such as sheet metal, and are generally cylindrical in shape. Holes 58 formed in each of the sections 50, 52, 54 enable a wire 60 to pass therethrough which may be coupled to an endpiece 62 for enabling removal of the section from the flue 18. If necessary, the wire may be fastened to a bar 64 supported at the top of the flue 18.

Preferably, the sections 50, 52, 54 are generally cylindrical and are either closed or sealed or are fitted with an end cap 68, 70 to prevent passage of combustion gases therethrough. This, in effect, causes the combustion gases to pass through an annulus 74 established between the sections 50, 52, 54 and flue 18.

In order to further enhance contact of the combustion gases with the flue 18, each of the plurality of segments 50, 52, 54 has different diameters indicated at $D_1$, $D_2$, $D_3$ in FIG. 2. It should be appreciated that while three segments are shown, it is contemplated that a greater or smaller number of segments may be provided within the concept of the present invention.

The segments 50, 52, 54 are assembled as shown in FIG. 2 so that the increased diameters $D_1$, $D_2$, $D_3$ provide for narrowing of the annulus 74 from a bottom 78 of the flue to the top 66 of the flue 18.

In order to facilitate nesting of the segments 50, 52, 54 on one another, conical ends 82, 84, 86 may be formed into the segments 50, 52, 54.

Importantly, the fins 46, shown in FIGS. 2 and 3, which may be formed from spring steel or the like, are attached to the segments 50, 52, 54 by welding or the like and extend, or protrude, outwardly therefrom in order to center the segments 50, 52, 54 within the flue 18 by contact of angled portions 90 with a flue inside surface. Thus, metal contact is established between the inside surface 92 of the flue 18 and each of the segments 50, 52, 54. This enables heat transferred to the segments 50, 52, 54 from combustion gases to be conducted directly into the flue wall 32 and thereafter into the surrounding water 36.

Although there has been hereinabove described specific arrangements of apparatus for the purpose of enhancing the efficiency of water heaters in illustrating the manner in which the invention can be used to advantage, it should be appreciated that the invention is not limited thereto. Accordingly, any and all modifications, variations, or equivalent arrangements which may occur to those skilled in the art, should be considered to be within the scope and spirit of the present invention as defined in the appended claims.

What is claimed is:

1. A control baffle for improving the efficiency of a water heater having a tank, a burner and a flue, said flue being disposed within said tank for evacuation of burned combustion gases therethrough with resulting heating of water in said tank, said control baffle comprising:

combustion gas directing means for enhancing heat transfer from the combustion gases through a flue wall and into surrounding water during ignition of said burner, said combustion gas directing means comprising an elongate member having means for both centering said elongate member within the flue and establishing an annulus between said elongate member and the flue for the passage of combustion gas said elongate member comprising a plurality of nestable segments.

2. The control baffle according to claim 1 wherein each of the plurality of segments is cylindrical and each has a different diameter to enable the assembly of the elongate member with a diameter smaller at a bottom of the elongate member than at the top of the elongate member.

3. The control baffle according to claim 2 wherein each of the nestable segments has conical end means for both enabling nesting of the segments with one another and for aligning the segments with one another within said flue.

4. The control baffle according to claim 3 further comprising means defining a coaxial opening through each of said segments and wire means for suspending the segments in a nested configuration within the flue, said wire means extending though the coaxial opening in each of the segments.

5. The control baffle according to claim 4 further comprising bar means, fixed to said wire means, for suspending the nested segments from a top of said flue.

6. Water heater apparatus comprising:

a tank;

a burner;

flue means, disposed in said tank, for evacuation of burner combustion gases therethrough with resulting heating of water in said tank;

combustion gas directing means for enhancing heat transfer from the combustion gases through a flue wall and into surrounding water during ignition of said burner, said combustion gas directing mens comprising an elongate member having means for both centering said elongate member within the flue and establishing an annulus between the member and the flue for the passage of combustion gas, said elongate member comprising a plurality of nestable segments.

7. The apparatus according to claim 6 wherein each of the plurality of segments is cylindrical and each has a different diameter to enable the assembly of the elongate member with a diameter smaller at a bottom of the elongate member than at the top of the elongate member.

8. The apparatus according to claim 7 wherein each of the nestable segments has conical end means for both enabling nesting of the segments with one another and for aligning the segments with one another within said flue.

9. The apparatus according to claim 8 further comprising means defining a coaxial opening through each of said segments and wire means for suspending the segments in a nested configuration within the flue, said wire means extending though the coaxial opening in each of the segments.

10. The apparatus according to claim 9 further comprising bar means, fixed to said wire means, for suspending the nested segments from a top of said flue.

* * * * *